US007331303B2

(12) United States Patent
Park

(10) Patent No.: US 7,331,303 B2
(45) Date of Patent: Feb. 19, 2008

(54) FLOATING POWER PLANT

(75) Inventor: Jae-Wook Park, 35-1003, Hanyang Apt., Apgujeong-Dong, Seoul (KR) 135-110

(73) Assignee: Jae-Wook Park, Seoul (KR)

( * ) Notice: Subject to any disclaimer, the term of this patent is extended or adjusted under 35 U.S.C. 154(b) by 0 days.

(21) Appl. No.: 11/381,017

(22) Filed: May 1, 2006

(65) Prior Publication Data

US 2006/0243186 A1 Nov. 2, 2006

(30) Foreign Application Priority Data

May 2, 2005 (KR) ..... 10-2005-0036724

(51) Int. Cl.
*B63B 35/00* (2006.01)

(52) U.S. Cl. ..... 114/264; 290/1 A

(58) Field of Classification Search ..... 114/26, 114/72, 73, 264, 265; 290/1 A
See application file for complete search history.

(56) References Cited

U.S. PATENT DOCUMENTS 1,952,520 A * 3/1934 Urquhart ..... 165/286
2,938,359 A * 5/1960 Cobb, Jr. et al. ..... 62/7
3,599,589 A * 8/1971 Busey ..... 114/264
3,606,036 A * 9/1971 Beebe et al. ..... 406/109
3,910,381 A * 10/1975 Csanady et al. ..... 184/6
4,808,835 A * 2/1989 Tsuji et al. ..... 290/4 A

* cited by examiner

*Primary Examiner*—Sherman Basinger
(74) *Attorney, Agent, or Firm*—Darby & Darby

(57) ABSTRACT

A floating power plant includes a hull having a structure suitable for being movable at sea; a plurality of watertight bulkheads placed in the hull to a height of a freeboard deck, thus partitioning the interior of the hull into a plurality of watertight chambers; a power generating equipment for generating electricity, the power generating equipment including a plurality of parts separately installed in the watertight chambers; and a duct arranged to pass over the freeboard deck to couple the parts of the power generating equipment installed in the watertight chambers to each other. The floating power plant can economically supply electricity to a specific district or to a specific facility that temporarily uses electricity, and can minimize limitations caused by environmental regulations, and can be used as an emergency electric power source.

8 Claims, 4 Drawing Sheets

FLOATING POWER PLANT

CROSS-REFERENCE TO RELATED APPLICATIONS

This application is a U.S. National Stage Application under 35 U.S.C. §119 of Korean Patent Application No. 10-2005-0036724, filed May 2, 2005.

BACKGROUND OF THE INVENTION

1. Field of the Invention

The present invention relates, in general, to floating power plants and, more particularly, to a floating power plant, which can is freely movable on the sea and does not require separate flumes for water or adjacent piers for the supply of generating fuel.

2. Description of the Related Art

Generally, power plants comprise equipment for converting thermal energy or mechanical energy into electrical energy, rotate a turbine using an energy source, such as water, oil, coal, natural gas, or nuclear power, and generate electricity using a power generator connected to the turbine. Such power plants have typically been classified into water power plants, steam power plants, nuclear power plants, etc. according both to the kind of energy source used in the power plants and to the power generation method. Furthermore, tidal power plants, using tidal energy, wind power plants, using wind energy, geothermal power plants, using subterranean heat energy, solar power plants, using solar energy, and magneto-hydrodynamic (MHD) power plants, using magneto-hydrodynamic energy have been actively studied in recent years for practical use thereof as power plants in the future.

However, the above-mentioned power plants are problematic in that it is very difficult to locate the facilities of the power plants in desirable locations, and the power plants impose a large initial investment on the owners.

For example, in the Korean Peninsula, having three sides surrounded by the sea, most power plants are built at the seaside because the generating fuel, which is coal, petroleum, or liquefied natural gas, which is imported from abroad, can be easily transported so that the transport charges of the fuel can be reduced and, furthermore, the large quantity of water that is required to operate the power plants can be easily obtained from the sea.

Furthermore, the locations of the power plants have been determined in consideration of environmental impact assessments, the possibility of disasters based on the geological characteristics of selected districts, the expected impacts of accidents on neighboring industrial facilities or explosive material storage facilities, the supply of fuel and water required to operate the power plants, and the expected power consumption by power consumers using electricity supplied by the power plants.

In recent years, power plants have become recognized as harmful facilities, so it is necessary to pay careful attention to trends of public opinion of local inhabitants or of non-governmental organizations (NGO), in addition to consideration of the conditions at locations. Thus, the determination of the locations of the power plants may be accompanied by further practical limitations.

Furthermore, in the case of a specific district, where a great quantity of electricity must be temporarily used, or of a district under development, which requires a great quantity of electricity, it is necessary to build a new power plant at the district to meet the electricity requirements of the district because there is no alternative plan. However, the installation of a new power plant in such a district must be accompanied by high investment and time consumption. Furthermore, if the amount of electric power consumption is remarkably reduced, or if the facilities using the electricity are removed, so that the use of electricity is discontinued, the power plant built in the specific district suffers from economic inefficiency. In an effort to solve the problem, electricity may be supplied to the specific district by extending the existing electric power supply network. However, the extension of the power supply network limits the quantity of electricity that can be supplied to the district.

SUMMARY OF THE INVENTION

Accordingly, the present invention has been made keeping in mind the above problems occurring in the related art, and an object of the present invention is to provide a floating power plant, which does not require separate adjacent piers for the supply of generating fuel or separate flumes for water, but is freely movable on the sea.

Another object of the present invention is to provide a floating power plant, which can economically supply electricity to a specific district or to a specific facility that temporarily uses electricity, and which minimizes the limitations caused by environmental regulations, and can be used as an emergency electric power source.

In order to achieve the above object, according to a preferred embodiment of the present invention, there is provided a floating power plant, comprising: a hull having a structure suitable for being moved at sea; a plurality of watertight bulkheads placed in the hull to the height of the freeboard deck, thus partitioning the interior of the hull into a plurality of watertight chambers; a power generating means for generating electricity, the power generating means comprising a plurality of parts separately installed in the watertight chambers defined by the watertight bulkheads in the hull; and a duct arranged to pass over the freeboard deck to couple the parts of the power generating means installed in the watertight chambers to each other.

In one aspect of the present invention, each of the watertight chambers may be configured as a chamber having an open top, with an overhead crane placed over the open top of the watertight chambers.

In another aspect of the present invention, the watertight bulkheads may comprise: a first bulkhead transversely placed in a bow of the hull to define a first watertight chamber in which a power generating unit is installed; a plurality of second bulkheads longitudinally and transversely placed in back of the first bulkhead to define second and third watertight chambers in which a boiler and a denitrification unit are respectively installed; a plurality of third bulkheads longitudinally and transversely placed in back of the second and third watertight chambers to define fourth, fifth and sixth watertight chambers which are arranged side by side in a transverse direction and in which a desulphurization unit is installed in an intermediate one of the fourth, fifth and sixth watertight chambers, both a lime/plaster storage tank and lime/plaster handling gear being installed in one side watertight chamber, and both fuel handling gear and a fuel storage tank being installed in the other side watertight chamber; and a plurality of fourth bulkheads placed in back of the third bulkheads to define seventh and eighth watertight chambers in which an engine and lodging facilities are installed, respectively.

In a further aspect of the present invention, the power generating unit may comprise a turbine, a power generator, an electric transformer, and the boiler.

In still another aspect of the present invention, the power generating unit may be connected to an inlet pipe at a first end thereof to draw sea water therein through the inlet pipe using an axial flow pump, and may be connected to an outlet pipe at a second end thereof to discharge sea water to the outside of the hull, wherein the inlet pipe and the outlet pipe are placed on either the starboard or larboard side opposite the watertight chamber having the power generating unit therein.

In yet another aspect of the present invention, the power generating means may further comprise a connector, which is provided in the bow of the hull to be detachably connected to a submarine power transmission line to transmit electricity from the power generating means.

In still another aspect of the present invention, the hull may further comprise a boiler fuel storage tank in surplus space outside the watertight chambers, thus storing fuel for the boiler in the boiler fuel storage tank.

In still another aspect of the present invention, the hull may be provided with a gas fuel storage tank at the stern to store liquefied natural gas therein.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
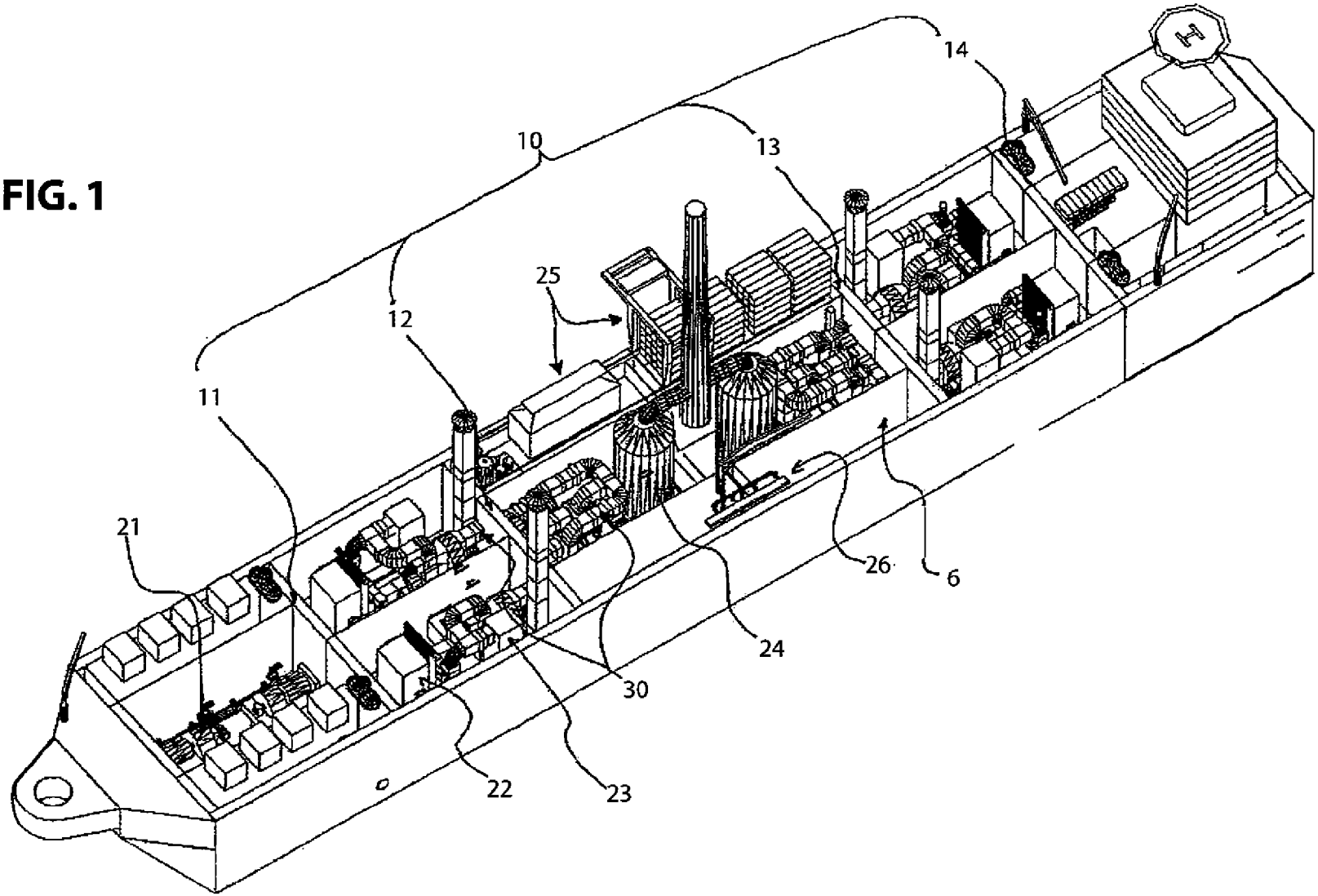
FIG. 1 is a perspective view illustrating a floating power plant according to the present invention.

Reference will now be made in greater detail to a preferred embodiment of the present invention, an example of which is illustrated in the accompanying drawings. Wherever possible, the same reference numerals will be used throughout the drawings and the description to refer to the same or like parts.

Herein below, a floating power plant according to a preferred embodiment of the present invention will be described with reference to the accompany drawings.

Figure 2:
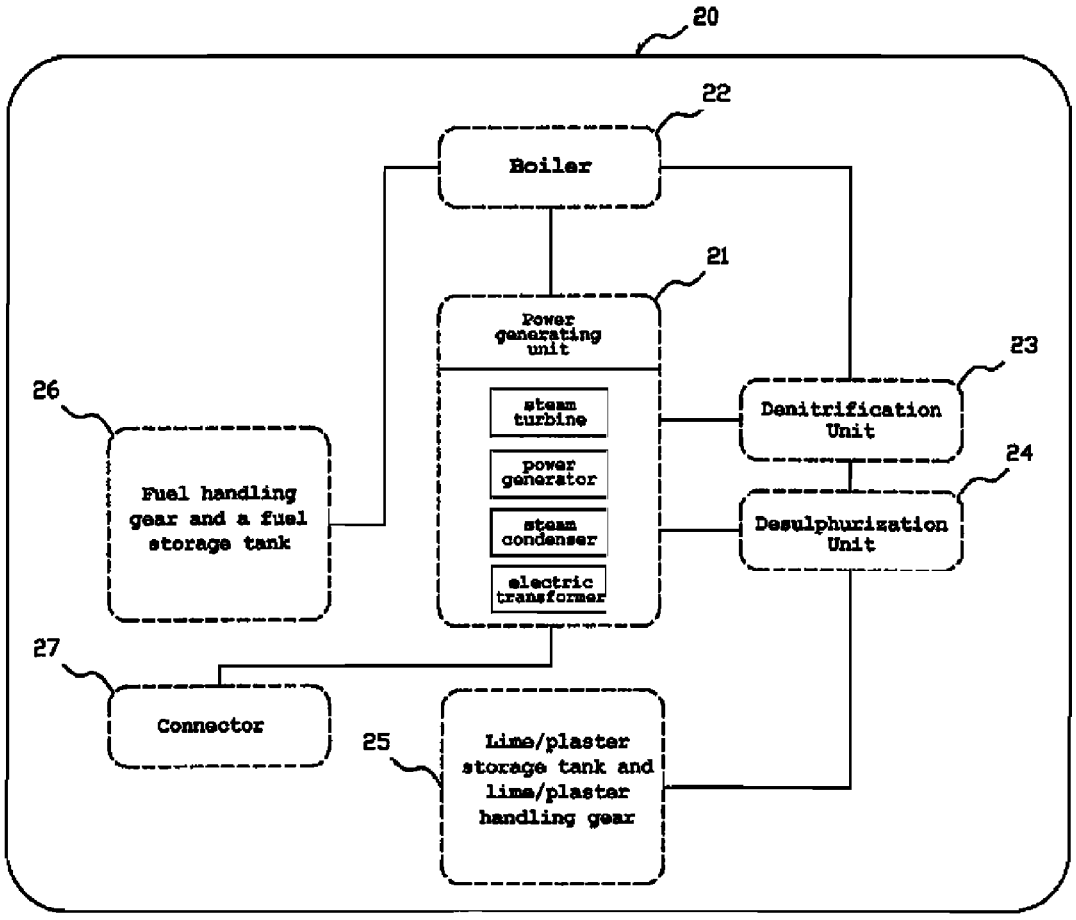
FIG. 2 is a block diagram illustrating the construction of a power generating means provided in the floating power plant according to the present invention.
Figure 3A:
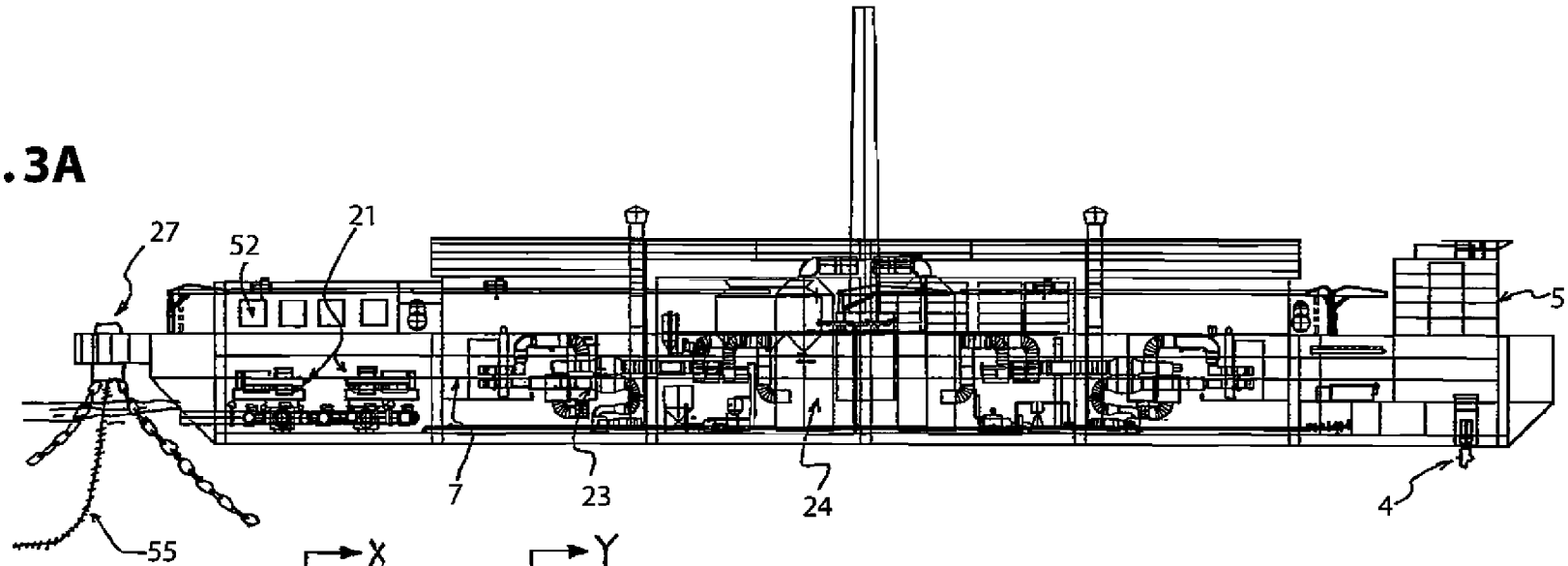
FIG. 3A is a profile view illustrating a floating power plant according to the present invention.
Figure 3B:
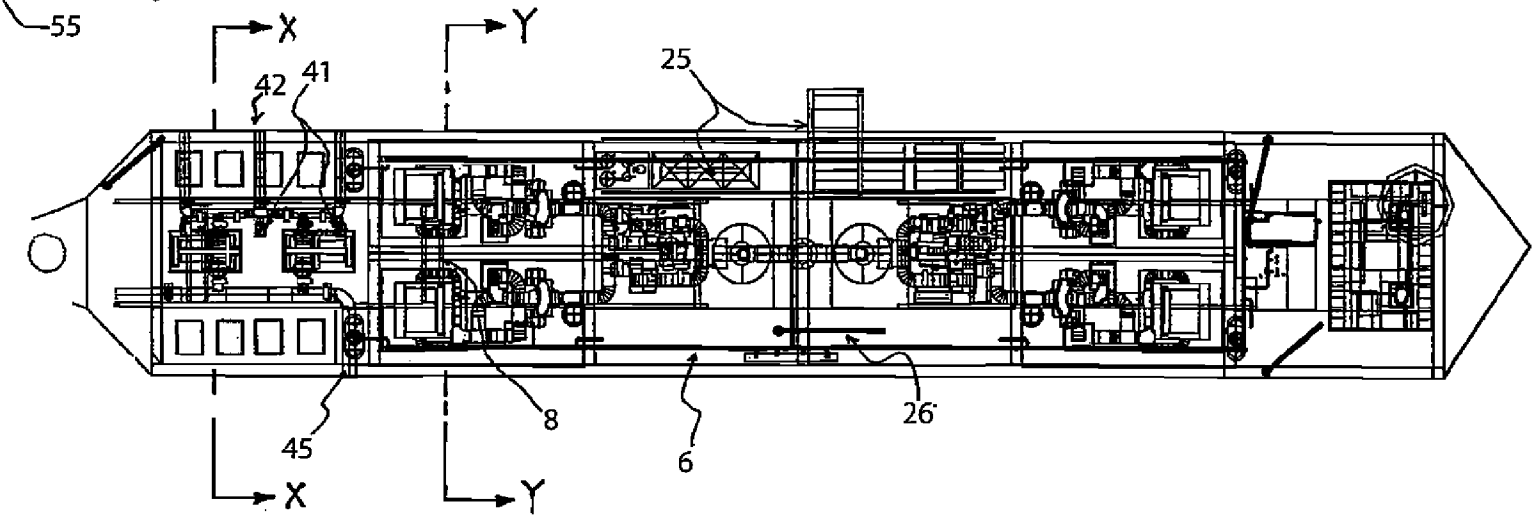
FIG. 3B is a plan view illustrating a floating power plant according to the present invention.
Figure 4A:
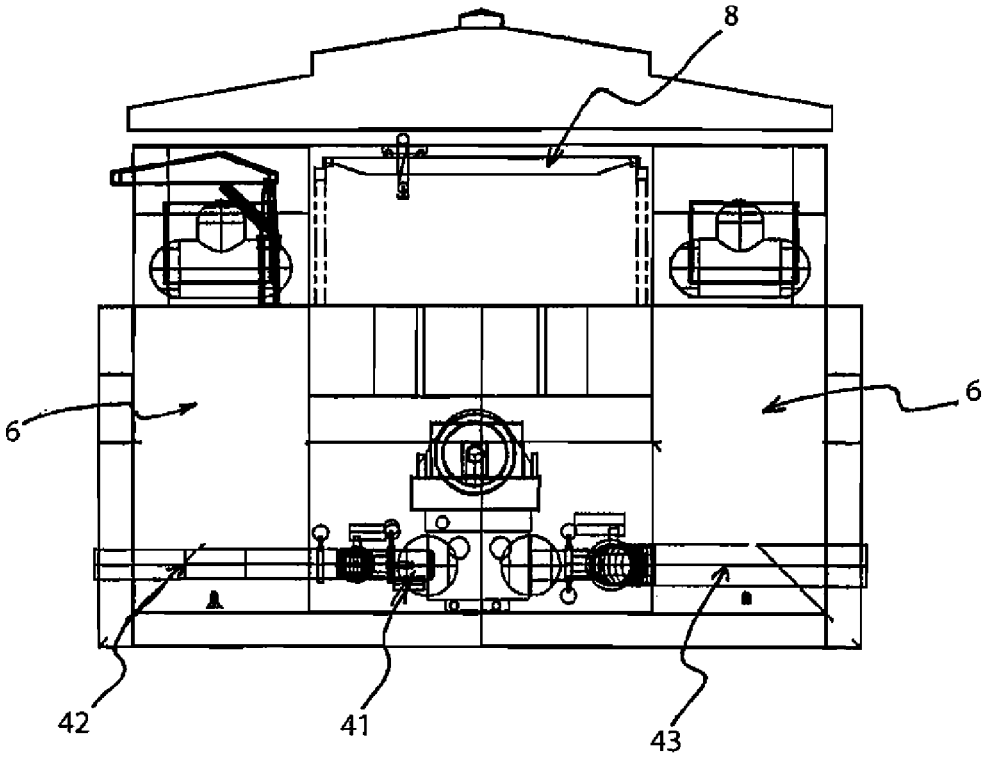
FIG. 4A is a cross sectional view along with line X-X of FIG. 3B.
Figure 4B:
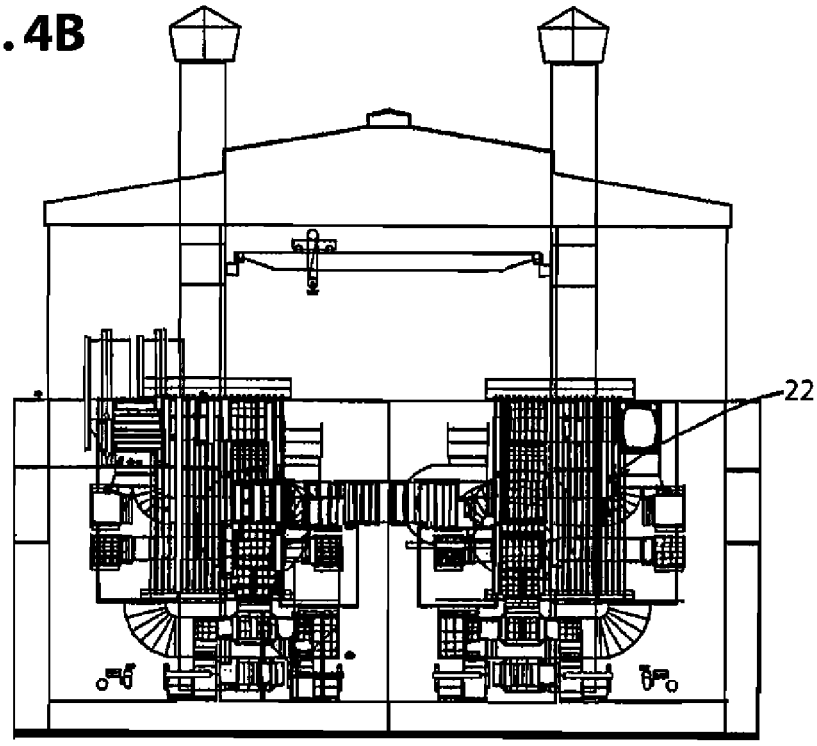
FIG. 4B is a cross sectional view along with line Y-Y of FIG. 3B.

FIG. 1 is a perspective view illustrating a floating power plant according to the present invention. FIG. 2 is a block diagram illustrating the construction of a power generating means provided in the floating power plant according to the present invention.

As shown in the drawings, the floating power plant according to the preferred embodiment of the present invention comprises a hull 1 having a structure suitable for being movable on the sea. A plurality of watertight bulkheads 10 is placed in the hull 1 to partition the interior of the hull 1 into a plurality of watertight chambers having respective spaces. In one aspect of the present invention, each of the watertight chambers may be configured as a chamber having an open top, with an overhead crane 8 placed over the open top of the watertight chambers. A power generating means 20, which generates electricity, is installed in the hull 1 such that a plurality of parts of the power generating means 20 is separately installed in the watertight chambers defined by the watertight bulkheads 10 in the hull 1. A duct 30 is arrayed to organically couple the parts of the power generating means 20 to each other.

The hull 1 has a watertight structure, so that the hull 1 can be prevented from foundering. In the hull 1, a keel longitudinally extends from the stem to the sternpost and is combined with a plurality of ribs, thus forming a framework of the hull 1. The framework of the hull 1 is also combined with the shells and decks, so that the framework of the hull 1 can be supported in longitudinal and latitudinal directions. In the present invention, the hull 1 provides a plurality of spaces for efficiently and separately carrying the parts of the power generating means 20 therein. Furthermore, the hull 1 is provided with an engine 4 and lodging facilities 5 therein.

The sizes and shapes of the engine 4 and the lodging facilities 5 provided in the hull 1 may be configured as conventional sizes and shapes, and further explanation for the engine 4 and the lodging facilities 5 are thus not deemed necessary.

The watertight bulkheads 10 are placed in the hull 1 at predetermined positions, so that the interior of the hull 1 is partitioned into a plurality of chambers to separately carry the parts of the power generating means 20.

The watertight bulkheads 10 divide the interior of the hull 1 into the watertight chambers, so that the parts of the power generating means 20 can be separately installed in the chambers in a way such that the power generating means 20 is efficiently prevented from foundering. In the preferred embodiment of the present invention, the watertight bulkheads 10 are placed in the interior of the hull 1 to a height of a freeboard deck.

The watertight bulkheads 10 comprise a plurality of bulkheads, which are longitudinally or transversely placed in the hull 1 as will be described in detail later herein.

A first bulkhead 11 is transversely placed at the bow of the hull 1 to define a first watertight chamber in which a power generating unit 21 is installed.

A second bulkhead 12 is transversely placed in back of the first bulkhead 11 at a position spaced apart from the first bulkhead 11 by a predetermined distance, with a subsidiary bulkhead longitudinally placed between the first bulkhead 11 and the second bulkhead 12 in the hull 1, thus defining second and third watertight chambers in the hull 1 between the first bulkhead 11 and the second bulkhead 12. A boiler 22 and a denitrification unit 23 are installed in the second and third watertight chambers, respectively.

A third bulkhead 13 is transversely placed in back of the second bulkhead 12 at a position spaced apart from the second bulkhead 12 by a predetermined distance, with two subsidiary bulkheads longitudinally placed between the second bulkhead 12 and the third bulkhead 13 in the hull 1 at spaced positions, thus defining fourth, fifth and sixth watertight chambers in the hull 1 between the second bulkhead 12 and the third bulkhead 13. The fourth, fifth and sixth watertight chambers are arranged side by side in a transverse direction of the hull 1. A desulphurization unit 24 is installed in the fifth watertight chamber, which is the intermediate chamber of the fourth, fifth and sixth watertight chambers. Both a lime/plaster storage tank and a lime/plaster handling gear 25 are installed in the fourth watertight chamber placed beside the intermediate chamber having the desulphurization unit 24, while both a fuel handling gear and a fuel storage tank 26 are installed in the sixth watertight chamber opposite the fourth watertight chamber.

A fourth bulkhead 14 is transversely placed in back of the third bulkhead 13 at a position spaced apart from the third bulkhead 13 by a predetermined distance, with a subsidiary bulkhead longitudinally placed between the third bulkhead 13 and the fourth bulkhead 14 in the hull 1, thus defining seventh and eighth watertight chambers. The engine 4 and the lodging facilities 5 are installed behind the seventh and eighth watertight chambers, respectively.

The construction of the above-mentioned watertight bulkheads 10 may be appropriately changed without affecting the functioning of the present invention according to the desired capacity, size and shape of the power generating means 20 installed in the watertight chambers if the bulkheads have a watertight structure.

The power generating means 20 for generating electricity comprises a plurality of parts, which are separately installed in the watertight chambers. Described in detail, the power generating means 20 comprises the power generating unit 21, the boiler 22, the denitrification unit 23, the desulphurization unit 24, the lime/plaster storage tank and lime/plaster handling gear 25, and the fuel handling gear and fuel storage tank 26.

The power generating unit 21 is installed in the first watertight chamber and comprises a power generator, a steam turbine, a steam condenser and an electric transformer. An inlet pipe is connected to a first end of the power generating unit 21, so that sea water can be drawn into the power generating unit 21 through the inlet pipe 42 using a pumping force of an axial flow pump 41. An outlet pipe 43 is connected to a second end of the power generating unit 21 and discharges sea water to the outside of the hull 1. In the present invention, the inlet pipe and the outlet pipe are preferably placed at either of the starboard and larboard sides opposite the watertight chamber having the power generating unit 21 therein.

The steam turbine is a machine, which receives high temperature and high pressure steam and generates a rotating force to actuate the power generator, thus causing the power generator to generate electricity. The steam turbine receives high temperature and high pressure steam from the boiler 22. The electric transformer is a machine to increase the voltage of electricity, generated by the power generator, to high voltage electricity. The high voltage electricity from the electric transformer 52 is transmitted to a connector 27. The connector 27 is provided at the bow of the hull 1 to detachably connect the power generating unit 21 to a submarine power transmission line 55, thus transmitting electricity from the power generating unit 21 to the submarine power transmission line.

In the present invention, the boiler 22 may comprise a single boiler or multiple boilers according to a desired capacity of the power generating unit 21. The boiler 22 is installed in the second watertight chamber and continuously generates steam. The steam of the boiler 22 can be supplied to the steam turbine and to the other subsidiary facilities requiring steam. The boiler 22 is preferably configured as a marine boiler, which has a self-correcting function against the rolling and pitching of the hull 1.

The denitrification unit 23 is preferably installed in a chamber outside the watertight chamber having the boiler 22. The denitrification unit 23 reduces the quantity of nitrogen oxides ($NO_x$) generated from the mixing of nitrogen both in the combustion air and in the fuel with oxygen in the hot boiler 22. The denitrification unit 23 may be efficiently operated through a variety of conventional denitrification techniques, such as two-stage combustion technique, exhaust gas recirculation technique, or low $NO_x$ combustion technique, and further explanation for the operation of the denitrification unit 23 is thus not deemed necessary.

The desulphurization unit 24 is installed in the fifth watertight chamber, which is the intermediate chamber of the fourth, fifth and sixth watertight chambers defined in the hull 1 between the second bulkhead 12 and the third bulkhead 13. The desulphurization unit 24 is a facility for preventing environmental pollution by adsorbing sulfur oxides ($SO_x$), which are generated during the combustion of fossil fuel, such as crude petroleum oil, and may be discharged to the atmosphere along with exhaust gases. The desulphurization unit 24 adsorbs the sulfur oxides ($SO_x$) using lime slurry before the sulfur oxides are discharged to the atmosphere, so that the sulfur oxides react with the lime slurry. Thus, the desulphurization unit 24 can remove the sulfur oxides while producing plaster as by-products. The desulphurization unit 24 can be configured and operated using conventional techniques and further explanation for the unit 24 is thus not deemed necessary.

The lime/plaster storage tank and the lime/plaster handling gear 25 are installed in either the fourth watertight chamber or the sixth watertight chamber, which is placed outside the fifth watertight chamber having the desulphurization unit 24. The fuel handling gear and the fuel storage tank 26 are installed in a remaining one of the fourth watertight chamber and the sixth watertight chamber. In other words, the lime/plaster storage tank and handling gear 25 and the fuel handling gear and storage tank 26 are installed in respective chambers outside the fifth chamber having the desulphurization unit 24.

Furthermore, a boiler fuel storage tank 6 may be provided in the surplus space outside the watertight chambers, so that fuel for boiler 22 can be stored in the boiler fuel storage tank. When liquefied natural gas (LNG) is used as the fuel for the boiler 22, a gas fuel storage tank may be provided in a chamber isolated from the lodging facilities at the stern, so that the liquefied natural gas can be stored in the gas fuel storage tank.

During the operation of the floating power plant, the boiler 22 of the power generating means 20 generates steam. The steam from the boiler 22 sequentially operates the steam turbine and the power generator, thus causing the power generator to produce electricity. The voltage of electricity is increased by the electric transformer and is transmitted to the submarine power transmission line through the connector 27.

The duct 30 is a pipe, which passes over the freeboard deck and organically connects the parts of the power generating means 20, installed in the watertight chambers, to each other. The duct 30 is placed above the freeboard deck 7, so that even though part of the hull 1 is unexpectedly broken, the duct 30 does not founder.

As described above, in the floating power plant according to the present invention, the interior of the hull 1 is partitioned into the watertight chambers by the watertight bulkheads 10, with the parts of the power generating means 20 being separately installed in the respective watertight chambers and being organically connected to each other by the duct 30. The floating power plant is operated as follows.

The floating power plant is freely movable on the sea, so that the power plant is not limited to the place. Thus, the floating power plant can be moved to any district having facilities requiring electricity or can generate electricity on the open sea.

When the boiler 22 is operated to produce steam, the steam sequentially operates the steam turbine and the power generator, thus causing the power generator to produce electricity. The voltage of electricity is increased by the electric transformer and the boosted electricity is transmitted to the connector 27. Because the connector 27 is detachably connected to a submarine power transmission line, the electricity can be transmitted to facilities requiring electricity.

During the operation of the boiler 22, both nitrogen oxides and sulfur oxides generated from the boiler 22 are filtered and removed by the denitrification unit 23 and the desulphurization unit 24, respectively. Lime and plaster produced from the denitrification and desulphurization processes are fed to the lime/plaster storage tank and are, thereafter, discharged to the outside of the power plant using the lime/plaster handling gear 25.

As apparent from the above description, the floating power plant according to the present invention provides advantages in that, because the floating power plant, provided with the power generating means, is freely movable at sea, the floating power plant can economically supply electricity to a specific district or to a specific facility that temporarily uses electricity, and can minimize limitations caused by environmental regulations, and can be used as an emergency electric power source. Thus, the floating power plant remarkably increases the degree of freedom while forming and managing an energy policy.

Furthermore, the present invention overcomes problems of conventional land power plants and, particularly, solves the problem of the waste of land caused by construction of power plants on land, and thus reduces environmental pollution.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A floating power plant, comprising:

a hull having a structure suitable for being movable on the sea;

a plurality of watertight bulkheads placed in the hull to a height of a freeboard deck, thus partitioning an interior of the hull into a plurality of watertight chambers;

power generating means for generating electricity, the power generating means comprising a plurality of parts separately installed in the watertight chambers defined by the watertight bulkheads in the hull; and a duct arrayed while passing over the freeboard deck to couple the parts of the power generating means installed in the watertight chambers to each other.

2. The floating power plant according to claim 1, wherein each of the watertight chambers is configured as a chamber having an open top, with an overhead crane placed over the open top of the watertight chambers.

3. The floating power plant according to claim 1, wherein the watertight bulkheads comprise:

a first bulkhead transversely placed in a bow of the hull to define a first watertight chamber in which a power generating unit is installed;

a plurality of second bulkheads longitudinally and transversely placed in back of the first bulkhead to define second and third watertight chambers in which a boiler and a denitrification unit are installed respectively;

a plurality of third bulkheads longitudinally and transversely placed in back of the second and third watertight chambers to define fourth, fifth and sixth watertight chambers which are arranged side by side in a transverse direction, and in which a desulphurization unit is installed in an intermediate one of the fourth, fifth and sixth watertight chambers, both a lime/plaster storage tank and lime/plaster handling gear being installed in one side watertight chamber, and both fuel handling gear and a fuel storage tank being installed in another side watertight chamber; and a plurality of fourth bulkheads placed in back of the third bulkheads to define seventh and eighth watertight chambers in which an engine and lodging facilities are installed, respectively.

4. The floating power plant according to claim 3, wherein the power generating unit is connected to an inlet pipe at a first end thereof to draw sea water there in through the inlet pipe using an axial flow pump, and is connected to an outlet pipe at a second end thereof to discharge sea water to the outside of the hull, wherein the inlet pipe and the outlet pipe are placed at either of starboard and larboard sides opposite the watertight chamber having the power generating unit therein.

5. The floating power plant according to claim 1, wherein the power generating means comprises a power generating unit comprising a turbine, a power generator, an electric transformer, and a marine boiler.

6. The floating power plant according to claim 5, wherein the power generating unit is connected to an inlet pipe at a first end thereof to draw sea water there in through the inlet pipe using an axial flow pump, and is connected to an outlet pipe at a second end thereof to discharge sea water to the outside of the hull, wherein the inlet pipe and the outlet pipe are placed at either of starboard and larboard sides opposite the watertight chamber having the power generating unit therein.

7. The floating power plant according to claim 1, wherein the power generating means comprises a connector, which is provided at a bow of the hull to be detachably connected to a submarine power transmission line to transmit electricity from the power generating means.

8. The floating power plant according to claim 1, wherein the hull further comprises a boiler fuel storage tank provided in surplus space outside the watertight chambers, thus storing fuel for boiler in the boiler fuel storage tank.

* * * * *

UNITED STATES PATENT AND TRADEMARK OFFICE

CERTIFICATE OF CORRECTION

PATENT NO. : 7,331,303 B2
APPLICATION NO. : 11/381017
DATED : February 19, 2008
INVENTOR(S) : Jae-Wook Park It is certified that error appears in the above-identified patent and that said Letters Patent is hereby corrected as shown below:

Title Page, Item (73) Assignee: should read:

--(73) Assignee: Mi-Yeong Kim, Seoul (KR)--.

Signed and Sealed this
Twelfth Day of June, 2012

David J. Kappos

David J. Kappos
*Director of the United States Patent and Trademark Office*